US009239052B2

(12) United States Patent
Yamada et al.

(10) Patent No.: US 9,239,052 B2
(45) **Date of Patent: *Jan. 19, 2016**

(54) SCROLL COMPRESSOR HAVING OUT-OF-PHASE BACK PRESSURE CHAMBER AND COMPRESSION CHAMBER OIL-FEEDING PATHS

(75) Inventors: Sadayuki Yamada, Shiga (JP); Atsushi Sakuda, Shiga (JP); Yoshiyuki Futagami, Shiga (JP); Takashi Morimoto, Kyoto (JP); Nobuaki Ogawa, Shiga (JP); Yoshifumi Abe, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 282 days.

This patent is subject to a terminal disclaimer.

(21) Appl. No.: 13/388,344

(22) PCT Filed: Jun. 9, 2011

(86) PCT No.: PCT/JP2011/003264

§ 371 (c)(1),
(2), (4) Date: Feb. 1, 2012

(87) PCT Pub. No.: WO2011/155208

PCT Pub. Date: Dec. 15, 2011

(65) Prior Publication Data

US 2012/0128518 A1 May 24, 2012

(30) Foreign Application Priority Data

Jun. 11, 2010 (JP) ..... 2010-133630

(51) Int. Cl.
*F01C 1/02* (2006.01)
*F04C 18/02* (2006.01)

(Continued)

(52) U.S. Cl.
CPC ..... *F04C 18/0215* (2013.01); *F04C 29/028* (2013.01); *F04C 23/008* (2013.01); *F04C 2270/701* (2013.01)

(58) Field of Classification Search
CPC ..... F04C 18/0215; F04C 2270/701; F04C 23/008; F04C 29/028; F04C 18/02; F04C 23/00; F04C 27/00
USPC ..... 418/55.6, 55.1
See application file for complete search history.

(56) References Cited

U.S. PATENT DOCUMENTS 5,645,408 A * 7/1997 Fujio et al. ..... 418/55.4
6,074,186 A 6/2000 Lifson et al.

FOREIGN PATENT DOCUMENTS

AU 2009239310 A1 * 10/2009
CN 1137100 12/1996

(Continued)

OTHER PUBLICATIONS

International Search Report issued Sep. 13, 2011 in International (PCT) Application No. PCT/JP2011/003264.

(Continued)

*Primary Examiner* — Jorge Pereiro
*Assistant Examiner* — Paul Thiede
(74) *Attorney, Agent, or Firm* — Wenderoth, Lind & Ponack, L.L.P.

(57) ABSTRACT

A scroll compressor includes a back pressure chamber oil-feeding path for feeding lubricating oil from a high-pressure region to a back pressure chamber, and a compression chamber oil-feeding path for feeding lubricating oil from the back pressure chamber to a compression chamber. One phase in which the back pressure chamber oil-feeding path is communicated from the high-pressure region to the back pressure chamber and another phase in which the compression chamber oil-feeding path is communicated from the back pressure chamber to the compression chamber are shifted from each other, so that the back pressure chamber oil-feeding path and the compression chamber oil-feeding path are never put into the communicating state simultaneously. Thus, after a halt of the compressor, under-communication oil-feeding of the lubricating oil from the high-pressure region via the back pressure chamber to the compression chamber can be prevented.

3 Claims, 5 Drawing Sheets

(51) Int. Cl.
*F04C 29/02* (2006.01)
*F04C 23/00* (2006.01)

(56) References Cited

FOREIGN PATENT DOCUMENTS

| | | |
|---|---|---|
| CN | 1215806 | 5/1999 |
| JP | 59-185892 | 10/1984 |
| JP | 2006-70807 | 3/2006 |
| JP | 2007-182870 | 7/2007 |
| JP | 2008-14283 | 1/2008 |
| JP | 2009-52463 | 3/2009 |
| JP | 2010-106751 | 5/2010 |
| JP | 2010-121577 | 6/2010 |
| WO | WO 2009130878 A1 * | 10/2009 |

OTHER PUBLICATIONS

Notification Concerning Transmittal of International Preliminary Report on Patentability dated Dec. 27, 2012 in corresponding International Application No. PCT/JP2011/003264.
Notification of Transmittal of Translation of the International Preliminary Report on Patentability dated Jan. 24, 2013 in corresponding International Application No. PCT/JP2011/003264.
Extended European Search Report issued Apr. 30, 2014 in corresponding Application No. 11792167.6.
Office Action issued Oct. 28, 2014 in corresponding Chinese patent application No. 201180003182.2 (with partial English translation of Search Report).

* cited by examiner

SCROLL COMPRESSOR HAVING OUT-OF-PHASE BACK PRESSURE CHAMBER AND COMPRESSION CHAMBER OIL-FEEDING PATHS

TECHNICAL FIELD

The present invention relates to a scroll compressor for use in heating/cooling air conditioners, cooling devices such as refrigerators, heat-pump type hot water systems, and the like.

BACKGROUND ART

As to this type of scroll compressor, conventionally, there have been filed various patent applications relating to similar compressors from many manufacturers or the like, while various compressors as those for use in household room air conditioners or refrigerators have been in actual use. Also, those compressors are recently beginning to be used as compressors of automobile air conditioners.

Furthermore, for lubrication of compression mechanism sections or the like of those compressors, as disclosed in JP 2008-14283 A as an example, there is a method in which a throttle part is provided on a back pressure chamber oil-feeding path formed inside an orbiting scroll so that oil feeding is normally kept under specified restrictions.

SUMMARY OF INVENTION

However, with the conventional configuration, since oil feeding from a high-pressure region to the back pressure chamber is normally performed via the throttle part of the back pressure chamber oil-feeding path, oil is fed from the high-pressure region to the back pressure chamber by pressure differences even after a halt of the compressor, and furthermore oil is fed from the back pressure chamber to a compression chamber via a compression chamber oil-feeding path. As a result, lubricating oil stored in a liquid storage section decreases in quantity and the compression chamber is filled with lubricating oil, leading to a start-up failure at a restart-up as well as reliability degradation as a problem.

The present invention is provided to solve the problems of the conventional configuration, an object of the invention is to provide a scroll compressor which makes it possible to achieve a stable restart-up as well as improvement of the reliability after the restart-up.

In a first aspect of the invention, there is provided a scroll compressor having a motor and a compression mechanism section housed in a container, the compression mechanism section comprising:

an orbiting scroll formed by erecting a spiral lap on a panel board;

a fixed scroll combined with the orbiting scroll and formed by erecting a spiral lap on a panel board;

a main bearing member which is so placed as to set the orbiting scroll placed between the main bearing member and the fixed scroll and which works for holding a seal member, a compression chamber being defined between the orbiting scroll and the fixed scroll;

a high-pressure region and a back pressure chamber defined on a back face of the orbiting scroll by the seal member;

a back pressure chamber oil-feeding path for feeding lubricating oil from the high-pressure region to the back pressure chamber; and a compression chamber oil-feeding path for feeding lubricating oil from the back pressure chamber to the compression chamber, wherein the compression chamber oil-feeding path comprises a passage formed inside the orbiting scroll and a recess portion formed in the panel board of the fixed scroll, one opening of the passage is periodically overlapped with the recess portion in accordance with rotating motion of the orbiting scroll so that the back pressure chamber and the compression chamber are intermittently communicated with each other, one opening of the back pressure chamber oil-feeding path moves between an interior of the seal member and an exterior of the seal member so that the high-pressure region and the back pressure chamber are intermittently communicated with each other, and the back pressure chamber oil-feeding path and the compression chamber oil-feeding path are placed in such a positional relation as to prevent co-occurrence of communication from the high-pressure region to the back pressure chamber and communication from the back pressure chamber to the compression chamber.

In a second aspect of the invention, there is provided a scroll compressor according to the first aspect, wherein the compression chamber, with which the compression chamber-side opening of the compression chamber oil-feeding path is to be communicated, is a compression chamber in which the working fluid has been confined.

In the scroll compressor of the invention, one phase of under-communication oil-feeding from a high-pressure region to the back pressure chamber and another phase of under-communication oil-feeding from the back pressure chamber to the compression chamber are shifted from each other, thereby making it possible to prevent under-communication oil-feeding of the lubricating oil from the high-pressure region via the back pressure chamber to the compression chamber after a halt of the compressor, so that a stable restart-up is implementable and the reliability after a restart-up is improved.

DETAILED DESCRIPTION OF INVENTION

A scroll compressor according to a first aspect of the invention includes a back pressure chamber oil-feeding path for feeding lubricating oil from a high-pressure region to a back pressure chamber, and a compression chamber oil-feeding path for feeding lubricating oil from the back pressure chamber to a compression chamber, wherein when one opening of the back pressure chamber oil-feeding path moves between an interior of a seal member and an exterior of the seal member, the high-pressure region and the back pressure chamber are intermittently communicated with each other, while in the compression chamber oil-feeding path, which comprises a passage formed inside the orbiting scroll and a recess portion formed in a panel board of the fixed scroll, one opening of the passage is periodically overlapped with the recess portion in accordance with rotating motion of the orbiting scroll so that the back pressure chamber and the compression chamber are intermittently communicated with each other. With this configuration, since the back pressure chamber oil-feeding path and the compression chamber oil-feeding path can be placed in such a positional relation as to prevent co-occurrence of communication from the high-pressure region to the back pressure chamber and communication from the back pressure chamber to the compression chamber, under-communication oil-feeding of the lubricating oil from the high-pressure region via the back pressure chamber to the compression chamber after a halt of the compressor can be prevented. As a result, there occurs neither decrease of the lubricating oil in the liquid storage section nor filling of the lubricating oil into the compression chamber, thus making it possible to achieve a stable restart-up as well as to improve the reliability after a restart-up.

In a second aspect of the invention, in the scroll compressor as described in the first aspect, in particular, the compression chamber with which the back pressure chamber is to be communicated via the compression chamber oil-feeding path is a compression chamber in which a working fluid has already been confined. With this configuration, it is possible to prevent a so-called tilting phenomenon in which separation of the orbiting scroll from the fixed scroll causes power declines. Further, even if the tilting occurs, the pressure of the compression chamber can be led to the back pressure chamber, and it is possible to make an early restoration of normal operation.

Hereinbelow, an embodiment of the present invention will be described with reference to the accompanying drawings. It is noted that the invention is not limited by this embodiment.

Figure 1:
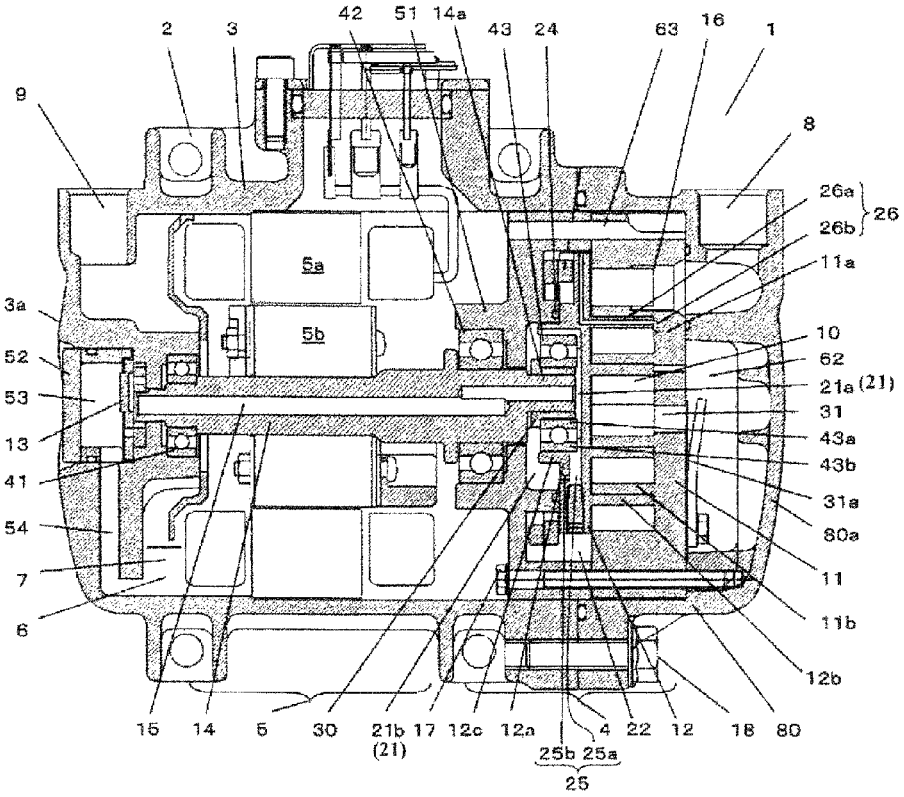
FIG. 1 is a sectional view of a scroll compressor according to an embodiment of the present invention.
Figure 2B:
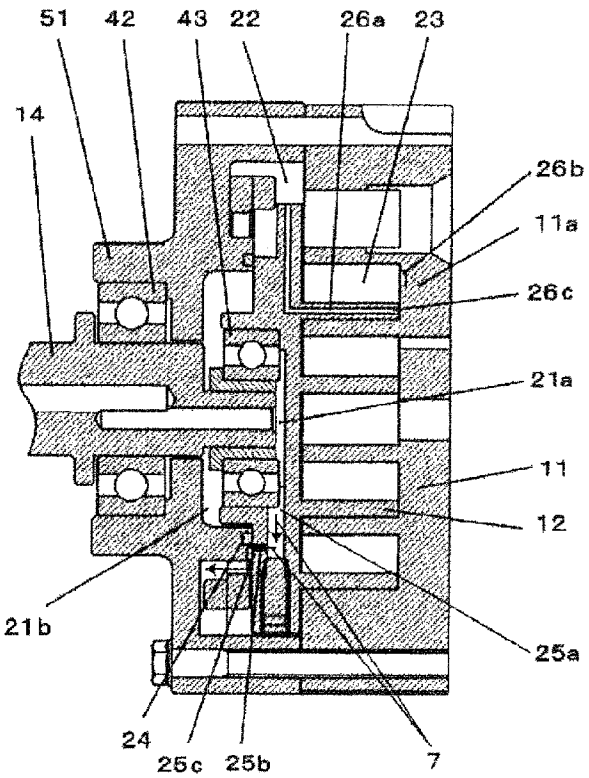
FIGS. 2 (*a*) and (*b*) are enlarged sectional views showing operation of a compression mechanism section of the scroll compressor of FIG. 1.
Figure 2A:
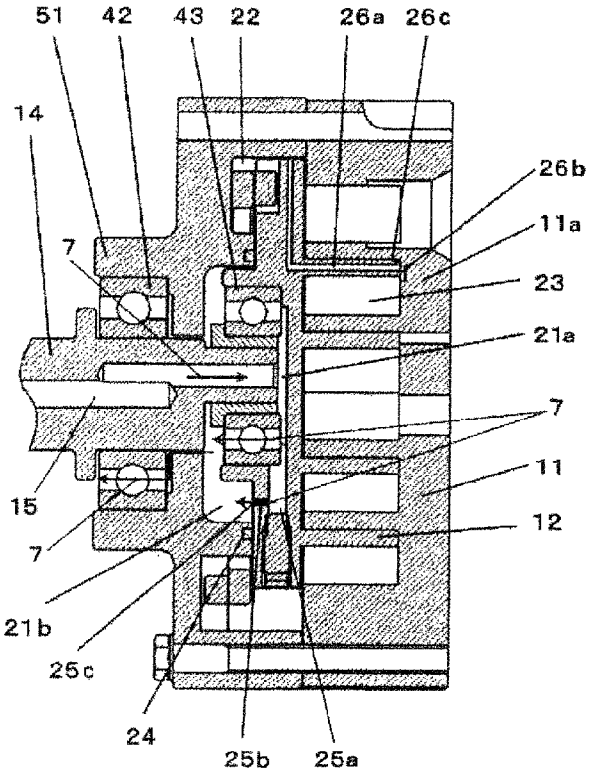
Figure 3A:
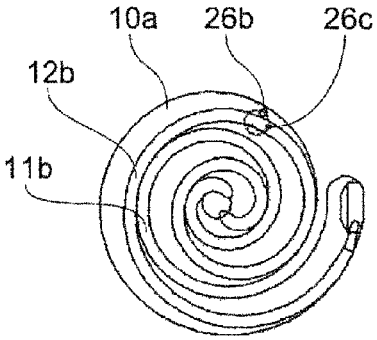
FIGS. 3 (*a*)-(*d*) are enlarged sectional views showing states in which an orbiting scroll and a fixed scroll of the scroll compressor of FIG. 1 are combined together.
Figure 3B:
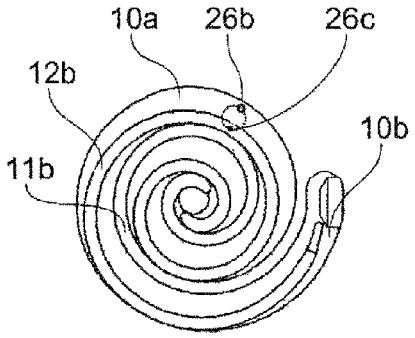
Figure 3D:
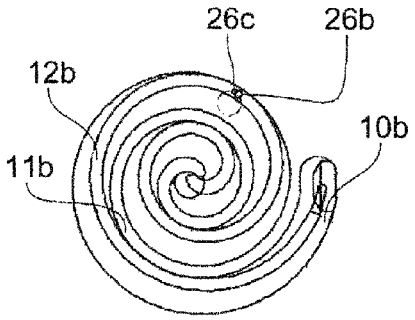
Figure 3C:
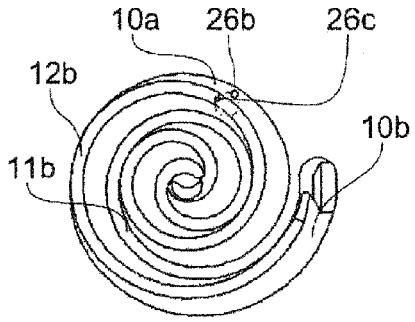
Figure 4A:
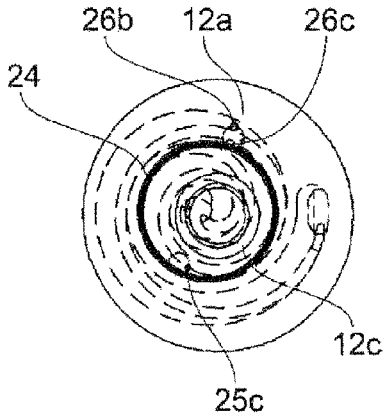
FIGS. 4 (*a*)-(*d*) are enlarged plan views showing a back face of the orbiting scroll of the scroll compressor of FIG. 1.
Figure 4B:
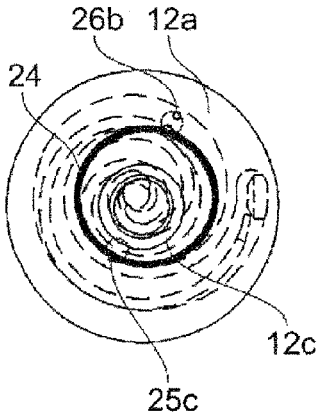
Figure 4D:
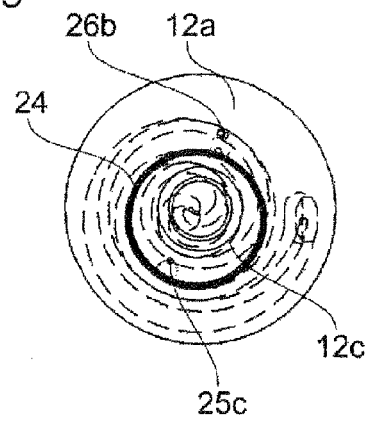
Figure 4C:
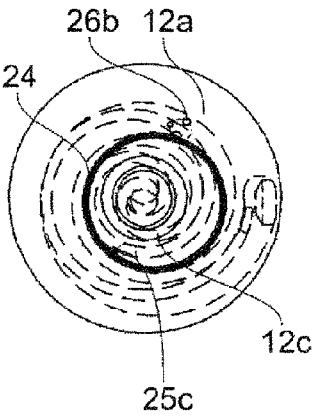
Figure 5:
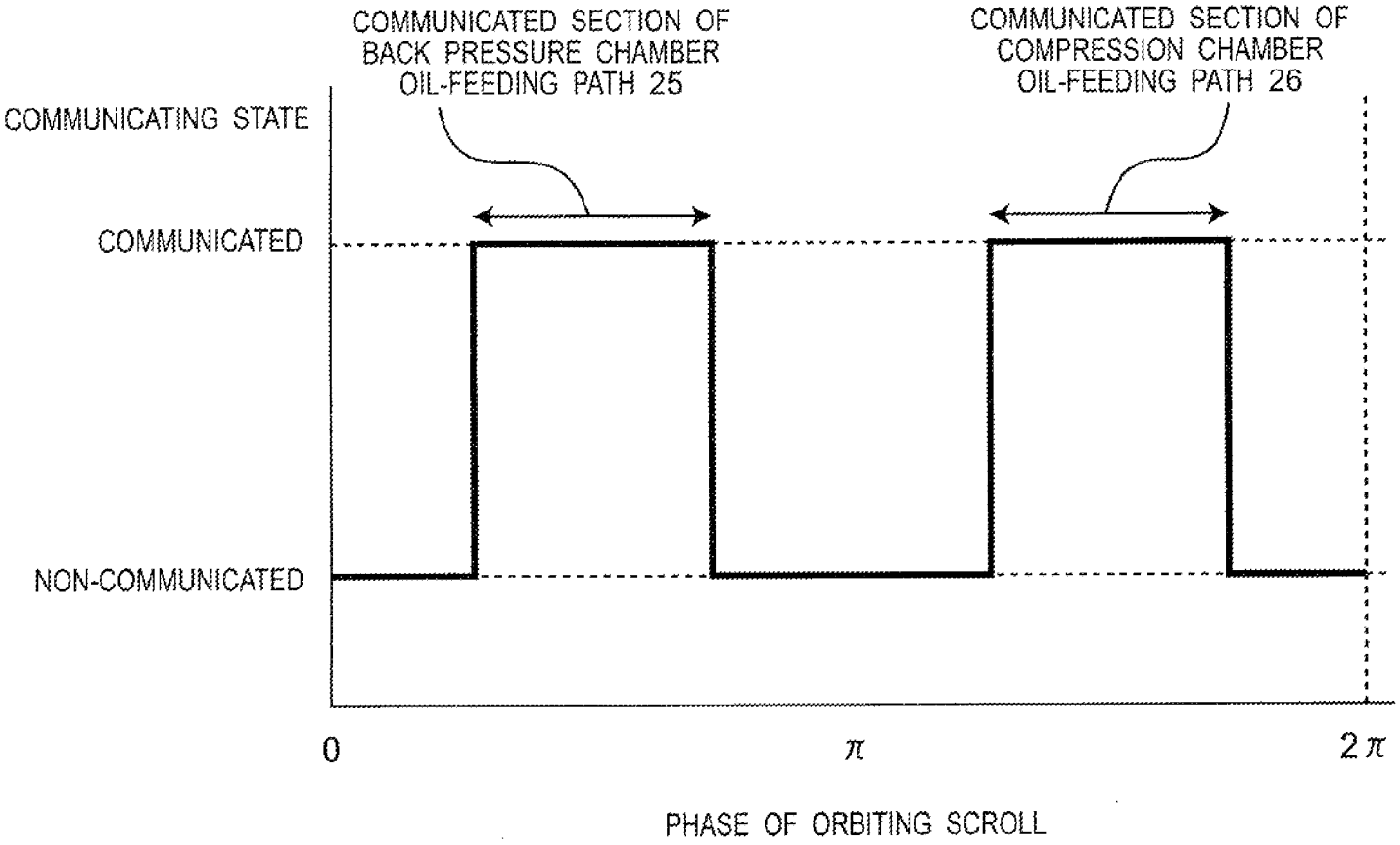
FIG. 5 is a chart showing states in which the back pressure chamber oil-feeding path and the compression chamber oil-feeding path of the scroll compressor of FIG. 1 are communicated with each other.

FIG. 1 is a sectional view of a scroll compressor according to an embodiment of the invention. FIGS. 2 (*a*), (*b*) are enlarged sectional views of a compression mechanism section of FIG. 1. FIGS. 3 (*a*)-(*d*) are sectional views showing states in which an orbiting scroll and a fixed scroll of the scroll compressor are combined together. FIGS. 4 (*a*)-(*d*) are plan views showing a back face of the orbiting scroll of the scroll compressor. FIG. 5 is a chart showing states in which the back pressure chamber oil-feeding path and the compression chamber oil-feeding path are communicated with each other.

FIG. 1 shows a lateral type scroll compressor 1, which is to be installed in a lateral orientation with mounting legs 2 provided around the barrel portion of the scroll compressor. The scroll compressor 1 has, in its main casing 3, a compression mechanism section 4 and a motor 5 for driving the compression mechanism section, with inclusion of a liquid storage section 6 for storing lubricating oil 7. The motor 5 is driven by an unshown motor driving circuit. A working fluid to be treated is a gas refrigerant, and the lubricating oil 7 working for lubrication of individual sliding portions is used also as a seal of the sliding portion of the compression mechanism section 4, where a lubricating oil having compatibility with the refrigerant is used. However, the present invention is not limited to these. The scroll compressor 1 basically has only to be such that the compression mechanism section 4 for performing the suction, compression and discharge of the working fluid, and the motor 5 for driving the compression mechanism section 4, and the liquid storage section 6 for storing a liquid to be used for lubrication of individual sliding portions including the compression mechanism section 4 are contained in the main casing 3 while the motor 5 is driven by the motor driving circuit section, without being limited to the following description.

The compression mechanism section 4 is made up of a orbiting scroll 12 formed by erecting a spiral lap 12*b* on a panel board 12*a*, a fixed scroll 11 combined with the orbiting scroll 12 and formed by erecting a spiral lap 11*b* on a panel board 11*a*, and a main bearing member 51 which is so placed as to set the orbiting scroll 12 placed between the main bearing member and the fixed scroll 11 and which works for holding a seal member 24.

The fixed scroll 11 has a suction port 16 formed at an outer peripheral portion of the panel board 11*a*, and a discharge port 31 formed at a central portion of the panel board 11*a*. The orbiting scroll 12 has a cylindrical boss portion 12*c* in the back face.

An eccentric shaft 14*a* is formed integrally at one end of a drive shaft 14, and the eccentric shaft 14*a* is supported by the cylindrical boss portion 12*c* via an eccentric rolling bearing 43. It is noted that the eccentric shaft 14*a* is fitted with a bushing 30. Then, an inner ring 43*a* of the eccentric rolling bearing 43 is fitted into the bushing 30, while an outer ring 43*b* of the eccentric rolling bearing 43 is loosely fitted into the cylindrical boss portion 12*c* with a slight clearance. The drive shaft 14 is supported on its one end side by the main bearing member 51 via a main rolling bearing 42.

The seal member 24 is placed at the back face of the panel board 12*a* of the orbiting scroll 12. The back face of the panel board 12*a* of the orbiting scroll 12 is divided by the seal member 24 so that a high-pressure region 21 is formed inside the seal member 24 while a back pressure chamber 22 is formed outside the seal member 24.

The high-pressure region 21 includes a first high-pressure region 21*a* surrounded by inside of the cylindrical boss portion 12*c* and the eccentric rolling bearing 43, and a second high-pressure region 21*b* surrounded by the main bearing member 51, outside of the cylindrical boss portion 12*c*, the eccentric rolling bearing 43 and the main rolling bearing 42. The second high-pressure region 21*b* has an oil sump in its lower portion.

A back pressure chamber oil-feeding path 25 for feeding the lubricating oil 7 from the high-pressure region 21 to the back pressure chamber 22 is formed in the panel board 12*a* of the orbiting scroll 12. The back pressure chamber oil-feeding path 25 is made up of a first back pressure chamber oil-feeding path 25*a* communicating with the first high-pressure region 21*a*, and a second back pressure chamber oil-feeding path 25*b* whose one opening 25*c* is moved between an interior of the seal member 24 and an exterior of the seal member 24, where the first back pressure chamber oil-feeding path 25*a* and the second back pressure chamber oil-feeding path 25*b* are communicated with each other.

A compression chamber oil-feeding path 26 is made up of a passage 26*a* formed inside the orbiting scroll 12, and a recess portion 26*b* formed in a lap bottom face of the panel board 11*a* of the fixed scroll 11, and the compression chamber oil-feeding path 26 feeds the lubricating oil 7 from the back pressure chamber 22 to a compression chamber 10. A compression chamber-side opening 26*c* of the passage 26*a* is formed at a tooth tip of the spiral lap 12*b* of the orbiting scroll 12, and its periodical overlapping with the recess portion 26*b* along with rotating motion of the orbiting scroll 12 causes the back pressure chamber 22 and the compression chamber 10 to be intermittently communicated with each other.

The compression chamber 10 is defined by mutual meshing of the spiral lap 11*b* of the fixed scroll 11 and the spiral lap 12*b* of the orbiting scroll 12. When the orbiting scroll 12 is put into rotating motion with respect to the fixed scroll 11, the compression chamber 10 is changed in capacity while being moved. A refrigerant gas fed back from an external cycle is sucked through the suction port 16 into the compression chamber 10, and the refrigerant gas compressed in the compression chamber 10 is discharged through the discharge port 31 into a discharge chamber 62.

A discharge port 9 for discharging out compressed refrigerant gas is provided in the main casing 3, while a suction port 8 for sucking in refrigerant gas to be compressed is provided in a sub-casing 80. The main casing 3 and the sub-casing 80 make up a container.

Further placed in the scroll compressor 1 are a pump 13, a sub rolling bearing 41, the motor 5, and the main bearing member 51 having the main rolling bearing 42 as listed in order from one end wall 3*a* in an axis line within the main casing 3. The pump 13 is housed from the outer surface of an end wall 3*a*, and fixedly fitted by a lid member 52. Also, a pump chamber 53 is formed inside the lid member 52, and the pump chamber 53 is communicated with the liquid storage section 6 via a suction passage 54. The sub rolling bearing 41 is supported by the end wall 3*a* so that one side of the drive shaft 14 connected to the pump 13 is supported. The motor 5, comprising a stator 5*a* and a rotor 5*b*, drives rotation of the drive shaft 14. The stator 5*a* is fixed by shrinkage fit or the like to an inner periphery of the main casing 3, while the rotor 5*b* is fixed to the drive shaft 14.

The main bearing member 51 is fixed to an inner periphery of the sub-casing 80 with a bolt 17 or the like, with a compression mechanism section 4 side of the drive shaft 14 borne by the main rolling bearing 42. To an outer surface of the main bearing member 51, the fixed scroll 11 is mounted with unshown bolts or the like, and the orbiting scroll 12 is pinched and set between the main bearing member 51 and the fixed scroll 11. Between the main bearing member 51 and the orbiting scroll 12 is provided an Oldham's ring for allowing the orbiting scroll 12 to perform rotating motion while preventing its self rotating.

Part of the compression mechanism section 4 exposed from the sub-casing 80 is covered with the main casing 3. The sub-casing 80 has an end wall 80*a* on one side axially opposite to the end wall 3*a*. The main casing 3 and the sub-casing 80 are fixed by a bolt 18 with their openings adjoining each other. The compression mechanism section 4 is positioned between the suction port 8 of the sub-casing 80 and the discharge port 9 of the main casing 3, the suction port 16 of the fixed scroll 11 is connected to the suction port 8 of the sub-casing 80, and the discharge port 31 of the fixed scroll 11 is connected to the discharge chamber 62 via a reed valve 31*a*. The discharge chamber 62 is communicated with a motor 5 side space by a communicating passage 63 formed in the fixed scroll 11 and the main bearing member 51. The communicating passage 63 may also be formed between the fixed scroll 11 as well as the main bearing member 51 and the main casing 3.

The motor 5 is driven by the motor driving circuit section so as to put the compression mechanism section 4 into rotating motion via the drive shaft 14 and moreover to drive the pump 13. In this case, the compression mechanism section 4, to which the lubricating oil 7 of the liquid storage section 6 is fed by the pump 13, undergoes lubricating and sealing actions. The refrigerant gas discharged to the discharge chamber 62 passes through the communicating passage 63 to the motor 5 and, while cooling the motor 5, is discharged from the discharge port 9 of the main casing 3. In the container, the lubricating oil 7 contained in the refrigerant gas is dissociated from the refrigerant gas by collisions and throttling action to perform lubrication of the sub rolling bearing 41.

The lubricating oil 7 stored in the liquid storage section 6 of the main casing 3, upon driving of the pump 13 by the drive shaft 14, is fed to an oil-feeding path 15 formed in the drive shaft 14. An outlet of the oil-feeding path 15 is formed at an end portion of the eccentric shaft 14*a*. It is noted that the feeding of the lubricating oil 7 to the oil-feeding path 15 may also be done by making use of a differential pressure in the main casing 3 instead of the driving of the pump 13.

Now the flow of the lubricating oil 7 in the compression mechanism section 4 is explained with reference to FIG. 2.

As the orbiting scroll 12 is driven into rotation, the lubricating oil 7 from the oil-feeding path 15 is fed to the first high-pressure region 21*a*.

In the state of FIG. 2(*a*), one opening 25*c* of the back pressure chamber oil-feeding path 25 is positioned on the high-pressure region 21 side of the seal member 24, so that the lubricating oil 7 is not fed to the back pressure chamber 22.

In this state, a portion of the lubricating oil 7 fed to the first high-pressure region 21*a* is fed to the second high-pressure region 21*b* through the eccentric rolling bearing 43. Also, another portion of the lubricating oil 7 fed to the first high-pressure region 21*a* is fed from the first high-pressure region 21*a* to the second high-pressure region 21*b*, due to the location that the one opening 25*c* of the second back pressure chamber oil-feeding path 25*b* is inside the seal member 24. The lubricating oil 7 fed to the second high-pressure region 21*b* as shown above passes through the main rolling bearing 42 so as to flow out into the motor 5 side space, being collected to the liquid storage section 6.

In the state of FIG. 2(*b*), since the one opening 25*c* of the back pressure chamber oil-feeding path 25 is positioned outside the seal member 24, part of the lubricating oil 7 fed to the first high-pressure region 21*a* is fed to the back pressure chamber 22 to back up the back pressure of the orbiting scroll 12.

Further, in the state of FIG. 2(*a*), the lubricating oil 7 fed to the back pressure chamber 22 is fed to a compression chamber 23 by communication from the back pressure chamber 22 to the compression chamber-side opening 26*c* of the compression chamber oil-feeding path 26 and to the recess portion 26*b* formed in the lap bottom face of the panel board 11*a* of the fixed scroll 11 so as to fulfill the sealing and lubrication of the fixed scroll 11 and the orbiting scroll 12. It is noted that the compression chamber-side opening 26*c* and the recess portion 26*b* are positioned out of communication with each other as shown in FIG. 2(*b*), the lubricating oil 7 is not fed to the compression chamber 23.

FIGS. 3(*a*), (*b*), (*c*) and (*d*) show states in which the orbiting scroll 12 is shifted in phase from the fixed scroll 11 in steps of 90 degrees.

As shown in the figures, the recess portion 26*b* is provided in a compression chamber 10*a* after confinement of the refrigerant gas as the working fluid therein, and not provided in a compression chamber 10*b* before the confinement of the refrigerant gas. That is, the compression chamber 10, with which the back pressure chamber 22 is to be communicated via the compression chamber oil-feeding path 26, is made to be the compression chamber 10*a* after the confinement of the working fluid thereinto, thus making it possible to prevent the so-called tilting phenomenon in which separation of the orbiting scroll 12 from the fixed scroll 11 causes power declines. Moreover, even if the tilting occurs, a pressure of the compression chamber 10 can be led to the back pressure chamber 22, so that an early restoration of normal operation can be fulfilled.

In such a case as shown in FIG. 3, in the state of FIG. 3(*d*), the compression chamber-side opening 26*c* is overlapped with the recess portion 26*b*, so that the lubricating oil 7 is fed from the back pressure chamber 22 to the compression chamber 10 by passing through the compression chamber oil-feeding path 26.

In contrast to this, in the states of FIGS. 3(*a*), (*b*) and (*c*), the compression chamber-side opening 26*c* is not overlapped with the recess portion 26*b*, so that the lubricating oil 7 is never fed from the back pressure chamber 22 to the compression chamber 10.

FIGS. 4(*a*), (*b*), (*c*) and (*d*) show states shifted in phase from one another in steps of 90 degrees, as in the case of FIG. 3.

As shown in FIG. 4, the back face of the orbiting scroll 12 is divided by the seal member 24 into the inner high-pressure region 21 and the outer back pressure chamber 22.

In the state of FIG. 4(*b*), since the opening 25*c* is opened to the back pressure chamber 22, which is closer to the exterior than the seal member 24, the lubricating oil 7 is fed from the high-pressure region 21 to the back pressure chamber 22.

In contrast to this, in the states of FIGS. 4(*a*), (*c*) and (*d*), since the opening 25*c* is opened to the high-pressure region 21, which is closer to the interior than the seal member 24, the lubricating oil 7 is never fed from the high-pressure region 21 to the back pressure chamber 22.

In this embodiment, the scroll compressor includes the back pressure chamber oil-feeding path 25 for feeding the lubricating oil 7 from the high-pressure region 21 to the back pressure chamber 22, and the compression chamber oil-feeding path 26 for feeding the lubricating oil 7 from the back pressure chamber 22 to the compression chamber 10, wherein one opening 25*c* of the back pressure chamber oil-feeding path 25 moves between an interior of the seal member 24 and an exterior of the seal member 24 so that the high-pressure region 21 and the back pressure chamber 22 are intermittently communicated with each other, and wherein the compression chamber oil-feeding path 26 comprises a passage 26*a* formed inside the orbiting scroll 12 and a recess portion 26*b* formed in a lap bottom face of the panel board 11*a* of the fixed scroll 11, and the compression chamber-side opening 26*c* of the passage 26*a* is opened to the recess portion 26*b* periodically in accordance with the rotating motion of the orbiting scroll so that the back pressure chamber 22 and the compression chamber 10 are intermittently communicated with each other. With this configuration, the back pressure chamber oil-feeding path 25 and the compression chamber oil-feeding path 26 can be positioned in one phase in which the back pressure chamber oil-feeding path 25 is communicated from the high-pressure region 21 to the back pressure chamber 22 as shown in FIG. 4(*b*) and another phase in which the compression chamber oil-feeding path 26 is communicated from the back pressure chamber 22 to the compression chamber 10 as shown in FIG. 3(*d*) wherein the communication states do not overlap with each other. Therefore, as shown in FIG. 5, the back pressure chamber oil-feeding path 25 and the compression chamber oil-feeding path 26 are never put into the communicating state simultaneously. Thus, after a halt of the compressor, under-communication oil-feeding of the lubricating oil 7 from the high-pressure region 21 via the back pressure chamber 22 to the compression chamber 10 can be prevented, so that the lubricating oil 7 in the liquid storage section 6 is kept from decreasing and moreover the lubricating oil 7 is kept from being filled into the compression chamber 10. Consequently, it becomes possible to achieve a stable restart-up, and the reliability after a restart-up is improved.

Further, the compression chamber 10 with which the compression chamber-side opening 26*c* of the compression chamber oil-feeding path 26 is to be communicated is the compression chamber 10*a* in which the working fluid has been confined in this embodiment. As a result of this, the so-called tilting phenomenon in which separation of the orbiting scroll 12 from the fixed scroll 11 causes power declines can be prevented. Moreover, even if the tilting occurs, a pressure of the compression chamber 10 can be led to the back pressure chamber 22, so that an early restoration of normal operation can be fulfilled.

As described hereinabove, the scroll compressor according to this invention includes a back pressure chamber oil-feeding path for feeding lubricating oil from a high-pressure region to a back pressure chamber, and a compression chamber oil-feeding path for feeding lubricating oil from the back pressure chamber to a compression chamber, wherein when one opening of the back pressure chamber oil-feeding path moves between an interior of the seal member and an exterior of the seal member, the high-pressure region and the back pressure chamber are intermittently communicated with each other, while in the compression chamber oil-feeding path, which comprises a passage formed inside the orbiting scroll and a recess portion formed in a panel board of the fixed scroll, one opening of the passage is periodically overlapped with the recess portion in accordance with rotating motion of the orbiting scroll so that the back pressure chamber and the compression chamber are intermittently communicated with each other. With this configuration, since the back pressure chamber oil-feeding path and the compression chamber oil-feeding path can be placed in such a positional relation as to prevent co-occurrence of communication from the high-pressure region to the back pressure chamber and communication from the back pressure chamber to the compression chamber, under-communication oil-feeding of the lubricating oil from the high-pressure region via the back pressure chamber to the compression chamber after a halt of the compressor can be prevented. As a result, there occurs neither decrease of the lubricating oil in the liquid storage section nor filling of the lubricating oil into the compression chamber, thus making it possible to achieve a stable restart-up as well as to improve the reliability after a restart-up. Thus, the invention can also be applied for use in scroll fluid machinery such as air scroll compressors, vacuum pumps and scroll-type expanders without a limitation of the working fluid to a refrigerant.

The invention claimed is:

1. A scroll compressor comprising:

a motor and a compression mechanism section housed in a container, the compression mechanism section including:

an orbiting scroll including a spiral lap on a panel board;

a fixed scroll combined with the orbiting scroll and including a spiral lap on a panel board;

a main bearing member located such that the orbiting scroll is disposed between the main bearing member and the fixed scroll, wherein the main bearing member holds a seal member, and a compression chamber is defined between the orbiting scroll and the fixed scroll;

a high-pressure region and a back pressure chamber defined on a back face of the orbiting scroll by the seal member;

a back pressure chamber oil-feeding path configured to feed lubricating oil from the high-pressure region to the back pressure chamber, wherein the back pressure chamber oil-feeding path includes a first channel portion and a second channel portion; and a compression chamber oil-feeding path configured to feed lubricating oil from the back pressure chamber to the compression chamber, wherein the compression chamber oil-feeding path includes a first channel portion formed inside the orbiting scroll and a second channel portion formed in the panel board of the fixed scroll, the first channel portion of the compression chamber oil-feeding path is periodically overlapped with the second channel portion of the compression chamber oil-feeding path in accordance with a rotating motion of the orbiting scroll so that the back pressure chamber and the compression chamber are intermittently communicated with each other, the second channel portion of the back pressure chamber oil-feeding path moves between an interior of the seal member and an exterior of the seal member so that the high-pressure region and the back pressure chamber are intermittently communicated with each other, and the back pressure chamber oil-feeding path and the compression chamber oil-feeding path are placed in such a positional relation as to prevent co-occurrence of communication from the high-pressure region to the back pressure chamber and communication from the back pressure chamber to the compression chamber during a single 360 degree rotation of the orbiting scroll relative to a start of a discharge cycle during operation of the scroll compressor.

2. The scroll compressor according to claim 1, wherein the compression chamber contains a working fluid.

3. The scroll compressor according to claim 1, wherein the first channel portion of the compression chamber oil-feeding path is formed in the spiral lap of the orbiting scroll and the second channel portion of the back pressure chamber oil-feeding path is formed in the panel board of the orbiting scroll.

* * * * *